United States Patent [19]

Enomoto et al.

[11] Patent Number: 4,755,143

[45] Date of Patent: Jul. 5, 1988

[54] HINGEABLE CONNECTOR

[75] Inventors: Masahiro Enomoto, Inagi; Sinsuke Kunishi, Yamato, both of Japan

[73] Assignee: Molex Incorporated, Lisle, Ill.

[21] Appl. No.: 56,080

[22] Filed: Jun. 1, 1987

[30] Foreign Application Priority Data

Jul. 4, 1986 [JP] Japan ..... 61-103072

[51] Int. Cl.[4] ..... H01R 39/02

[52] U.S. Cl. ..... 439/31; 439/65

[58] Field of Search ..... 439/1, 31, 65, 74, 75, 439/286, 288

[56] References Cited

U.S. PATENT DOCUMENTS 4,273,401 6/1981 Katzin ..... 439/286
4,632,475 12/1986 Tomita ..... 439/65 X
4,715,819 12/1987 Iwasa et al. ..... 439/31

*Primary Examiner*—Eugene F. Desmond
*Attorney, Agent, or Firm*—John W. Cornell; Louis A. Hecht

[57] ABSTRACT

A hingeable connector assembly includes at least one female terminal mounted in a terminal mounting space formed in a female connector housing and at least one male terminal member mounted in a male connector housing. The female terminal and said male terminal are rotatable relative to each other while electrically mated.

2 Claims, 5 Drawing Sheets

HINGEABLE CONNECTOR

BACKGROUND OF THE INVENTION

1. Field of the Invention

The present invention relates to an improved hingeable connector assembly including at least one female terminal member and at least one male terminal member which are arranged to be rotatable relatively to each other, while holding their electrical connection.

2. Brief Description of the Prior Art

So-called hingeable connectors or rotatable connectors, have become widely used, with various objects for the purpose of maintaining electrical connection between two printed circuit boards while being rotated with respect to one another. The connector of this type makes it easier to mount electronic components in a limited space in a high density arrangement.

Hingeable connector assemblies usually have a male connector rotatably mateable with a female connector. Each connector includes a housing mounting one or more terminals. Depending on the size or shape of the area in which the hingeable connector assembly is mounted, the disposition of the male connector relative to the female connector when the two are mated may be important. If the area is small or oddly shaped, it may be difficult to mate the connectors together.

Heretofore, various types of hingeable connectors providing means for inserting one of the connectors to the other have been proposed. For example, Japanese Utility Model Application Laid-Open Nos. 142481/1985, 109187/1985, 166985/1985, 136080/1985, 160488/1985 and U.S. Pat. No. 4,632,475 disclose the hingeable connectors of this type.

The designs disclosed in these prior art references are different from each other, but they have a common means of mating the male and female connectors. The hingeable connector assembly includes an engaging pin projecting from the housing of one connector, while the housing of the other connector includes a groove arranged to receive said engaging pin. In this manner, the mating connectors are rotatably connected under guidance of the slidable engagement of the pin and the groove. Such a construction necessitates the operation of inserting the engaging pin of one of the housings into the groove of the other housing at the time of connecting the female connector with the male connector. Consequently, the following problems are caused:

(a) The direction in which the one is to be inserted into the other is limited by the form or the direction of the pin receiving groove.

(b) When the inserting direction is changed there may be a case where the connector cannot be used as a whole.

(c) There may be a case where freedom in design of the apparatus is limited.

(d) If various types of hingeable connector assemblies having different inserting directions are prepared in order to increase the freedom in design, the handling and/or managing operation of these many types of these assemblies are troublesome.

If the means of mechanically engaging the mating connectors together are not formed on the male and female connector housing but formed on the male and female terminals themselves, the freedom of the inserting direction of the one into the other may be obtained. However, the electrical contact point must be held at the center of rotation. This may be difficult to accomplish.

A means of effecting a rotatable electrical connection of this type is disclosed in U.S. Pat. No. 4,657,320 assigned to the assignee of the present invention.

SUMMARY OF THE INVENTION

It is the principal object of the present invention to provide a hingeable connector assembly in which a direction in which a female connector and a male connector are to be engaged to one another can be freely selected as desired to provide increased flexibility of design and use.

In order to attain the objects as described above, the present invention provides a hingeable connector assembly including:

a female connector including a housing having a terminal receiving recess and at least one female terminal mounted in said terminal receiving recess;

a male connector including a housing with at least one male terminal mounted therein adapted to rotatably mate with said female terminal;

the improvement comprising:

said female terminal including a pair of opposing terminal pieces with a holding space formed therebetween, said terminal pieces having contact portions on their opposing surfaces, respectively, one of said terminal pieces extending forwardly of the other and having an engaging projection on its opposing surface at the forward thereof;

said male terminal including a forward end portion of substantially circular shape, having an engaging hole, said forward end portion adapted to be received in said terminal mounting space so that the engaging projection of the female terminal is resiliently received within said engaging hole.

BRIEF DESCRIPTION OF THE DRAWINGS

The accompanying drawings illustrate a preferred embodiment of the present invention, in which.

DESCRIPTION OF THE PREFERRED EMBODIMENT

Now, the preferred embodiment of the present invention will be explained, with reference to the accompanying drawings.

Figure 4:
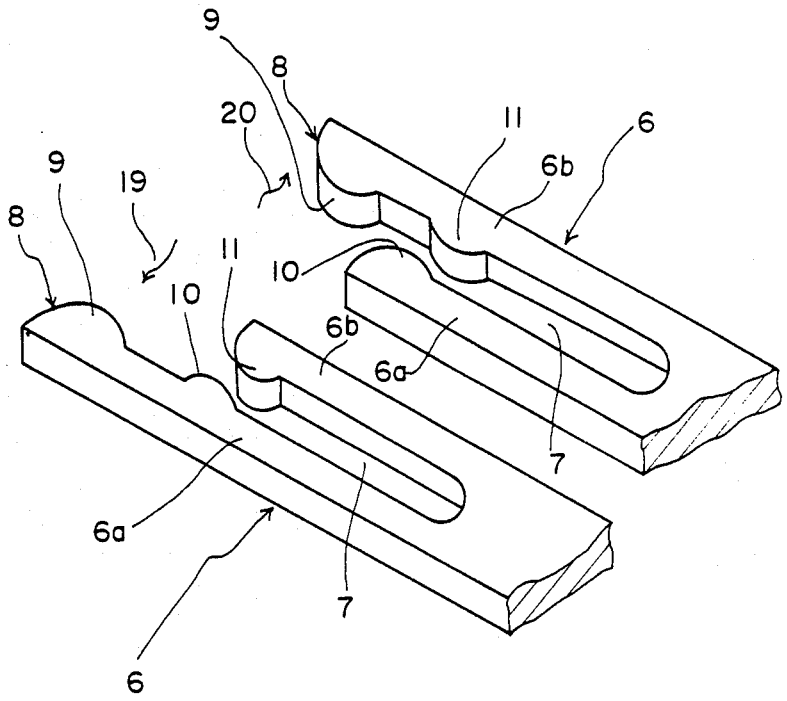
FIG. 4 is a perspective view, showing female terminals of the female connector half of the hingeable connector assembly of the present invention.

Referring to the drawings, the hingeable connector assembly, generally indicated by 1, includes a female connector 2 including a housing 4 having a plurality of mounting spaces 5 in its forward face and female terminals 6 disposed in the respective mounting spaces 5. The female terminal 6 includes a fork-like pair of right and left terminal pieces **6*a* and 6*b*, as shown in FIG. 4. The right and left terminal pieces 6*a* and 6*b* form a holding space 7 for holding a male terminal 15 therebetween, as hereinafter described. One of the terminal pieces 6*a* and 6*b*** extends forwardly of the other and an engaging projection 9 having a semi-spherical surface is formed on an opposing face of the forwardly extending piece.

The terminal pieces 6*a* and 6*b* have contact portions 10 and 11 on their opposing surfaces thereof. Terminal pieces 6*a* and 6*b* are arranged to make electrical contact with the male terminal 15. The female terminal 6 has a connecting part 12 at its rear end, which extends rearwardly beyond the housing 4. This connecting end 12 is arranged, for example, to be connected with a predetermined point of a printed circuit board 13.

The male connector 3 includes housing 14 and a plurality of male terminals 15 disposed in the housing. Each of the male terminals 15 extends forwardly from a front surface 14*a* of the housing 14. A forward end of the male terminal 15 is formed in substantially circular form and a tapered surface 17 is formed on the peripheral face thereof. An engaging hole 18 is formed at the center of said circular end.

The engaging hole 18 is arranged to receive the engaging projection 19. When the projection 19 engages hole 18, the female connector 2 and the male connector 3 are locked with each other, while they are rotatable relatively to each other around the connecting point.

A rear end 15*a* of the male terminal 15 extends from a rear surface 14*b* of the housing 14. The rear end 15*a* is arranged to be connected with a lead of an electronic circuit.

A plurality of the female terminals 6 and a plurality of the male terminals 15 are disposed on straight lines in the housing 4 and 14, respectively, with a predetermined pitch or center line spacing (for example, 2.5 mm pitch). The terminals 6 and 15 are electrically insulated from each other.

It is desired that the engaging projection 9 formed on one of the female terminals is directed to one direction as indicated by arrow 19 in FIG. 4. The engaging projection formed on an adjacent female terminal 6 is directed to the opposite direction as indicated by an arrow 20 in FIG. 4.

Figure 1:
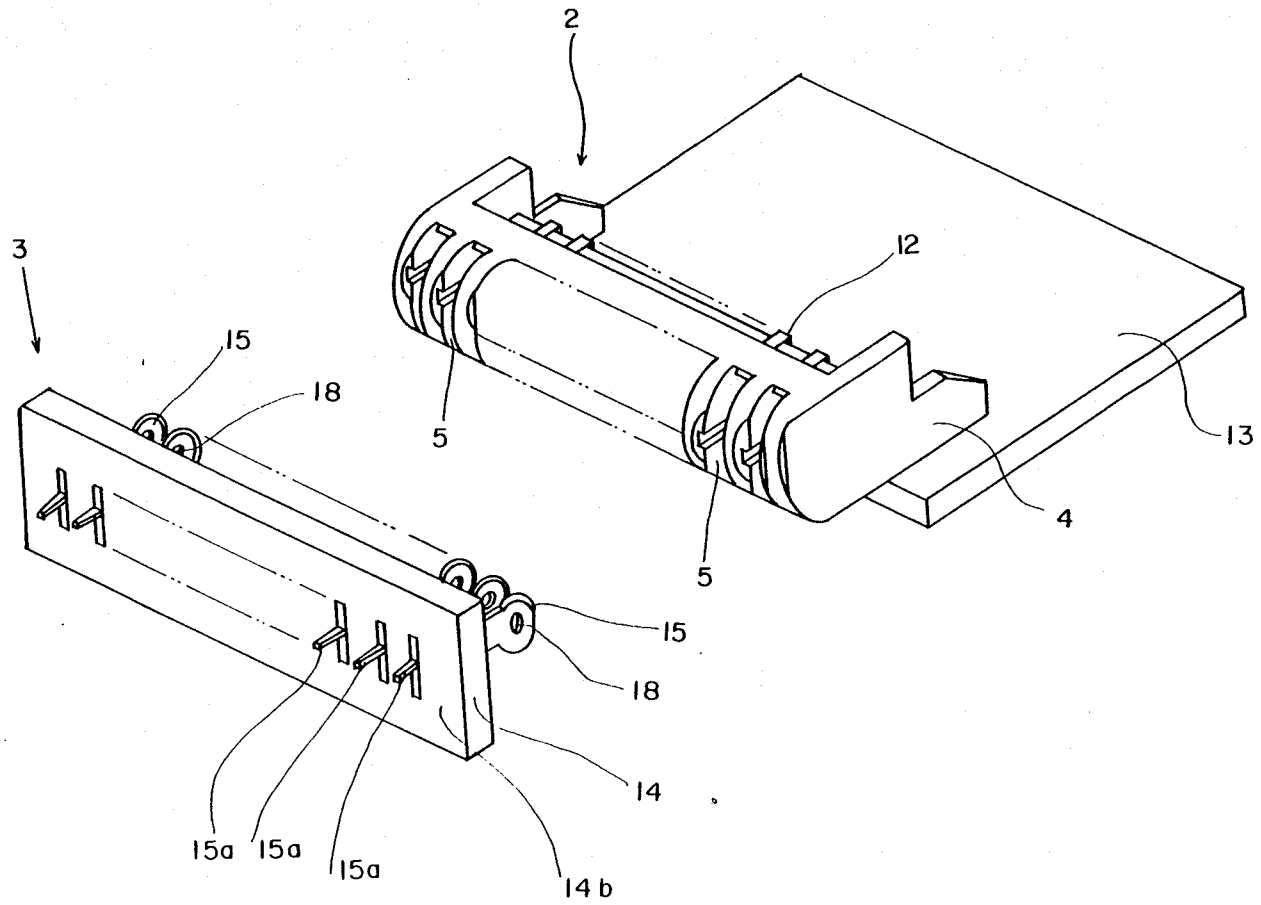
FIG. 1 is an exploded perspective view of the connector assembly of the present invention.
Figure 2:
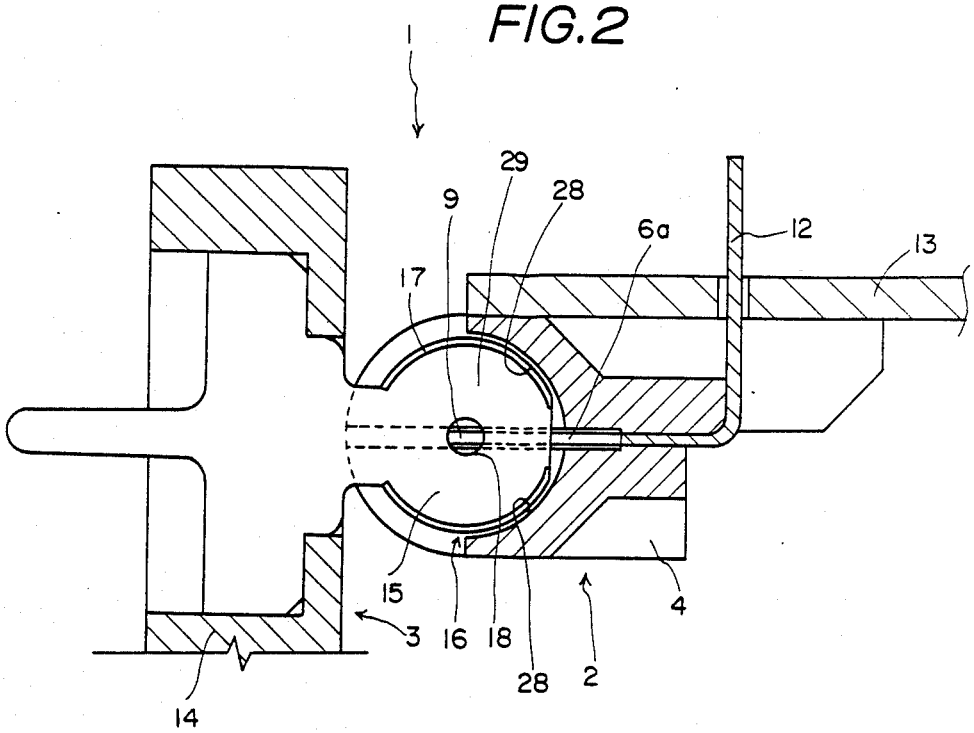
FIG. 2 is a side sectional view of the connector assembly of the present invention in its mated state.
Figure 3:
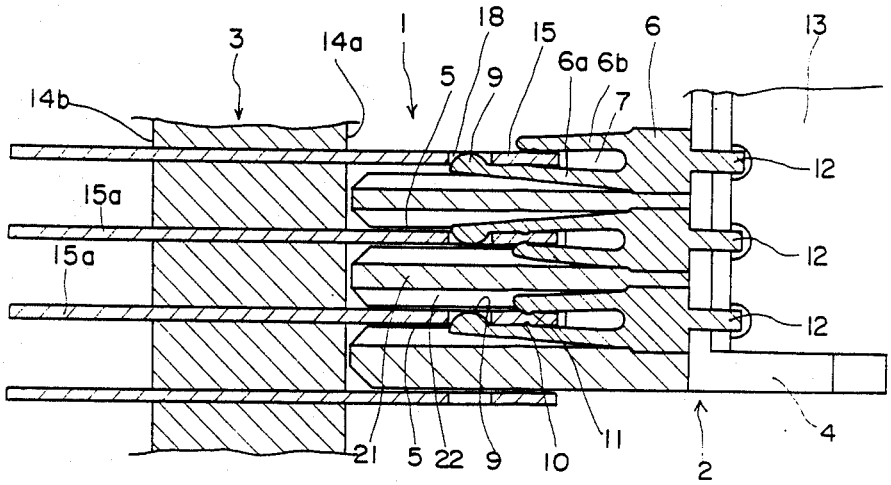
FIG. 3 is a top sectional view of the connector assembly of the present invention in its mated state.

The respective mounting spaces 5 for mounting the respective female terminals 4 are formed between the partition walls 21 projecting at the forward surface of the housing 4 at suitable distances. Each partition wall 21 has tapered guide surfaces 22 formed at its forward end to facilitate insertion of the male terminal into the space between the female terminals. Furthermore, a bottom wall 28 of the mounting space 5 between the respective partition walls 21 is formed in arcuate shape corresponding to the substantial circular shape of the forward end 29 of the male terminal 15, as shown in FIG. 2. As a result, when the female terminals 6 and the male terminals 15 are engaged with each other, the peripheral face of the forward end 29 of each male terminal 15 is positioned in opposite relation to the arcuate bottom wall 28, with a slight gap being held therebetween. If an accidental external force is applied to the female connector housing 4 or the male connector housing 14 from the top or bottom thereof, the peripheral surface of the forward end 29 and the arcuate wall 28 come into contact with each other. The terminals 6 and 15 support each other at their contacted portion, so that one of them is prevented from disconnecting from the other while maintaining the point of engagement at a same position at any time.

In operation, when the female connector 2 and the male connector 3 is inserted into the other, the respective engaging projection 9 formed on the forward ends 8 of the female terminals 6 of the female connector 2 come into the respective engaging holes 18 formed in the forward ends 16 of the male terminals 15 of the male connector 3. Thus, the female connector 2 and the male connector 3 are electrically mated and mechanically locked together in their electrically connected state.

In the mated state described, the circular end portion 29 of the male terminal 15 inserted into the female connector is guided by the arcuate bottom wall 28 of the mounting space 5, so that the engaging projection 9 comes into engagement with the engaging hole 18 precisely at the same position at any time.

Thus, the female connector 2 and the male connector 3 are freely rotatable relative to the other, while they are mechanically locked and electrically connected with each other. That is, the mechanical lock is obtained by the engagement of the engaging projection 9 formed at the forward end 8 of the female terminal 6 with the engaging hole 18 formed in the forward and portion 16 of the male terminal 15, so that a one-point lock is formed between them. The center of rotation is defined by the position of connection. At this stage, the contact portions 10 and 11 of the female terminal 6 constantly hold contact with the surface of the substantially circular male terminal 15.

At the time of bringing the engaging projection 9 into engagement with the engaging hole 18, the engaging projection can be brought from any direction around the male terminal 15. That is, the direction or angle in which one of the connectors is inserted into the other connector can be freely selected.

In use, the female connector 2 is mounted on a printed circuit board 13. When the printed circuit board 13 is horizontal as indicated by a solid line in FIG. 5, it is impossible to insert the connector in horizontal direction, owing to existence of a wall 23*a* of a casing 23 of an apparatus. It is not uncommon to form the casing 23 as an integral part by molding process of resinous material, and in such case it is very often impossible to insert the connector in head on mounting direction. In such case, it is necessary to insert the printed circuit board 13 in a more vertical direction and engage connectors 2 and 3. After engagement, the printed circuit board 13 is rotated to the horizontal position.

In case of a conventional construction of a hingeable connector assembly in which the pin and the pin receiving groove are formed in the connector housings, the inserting direction is limited to a predetermined one direction depending upon the form of the pin receiving groove. Accordingly, when the inserting direction is as indicated by an arrow 24 in FIG. 5, for example, it is impossible to insert the connector if another electronic part 25 has been already disposed on the way of the inserting directions. On the other hand, in case of the present invention, the inserting direction can be freely selected, so that the connector can be easily inserted in the direction as indicated by an arrow 26 even if the electronic part 25 exists.

Figure 5:
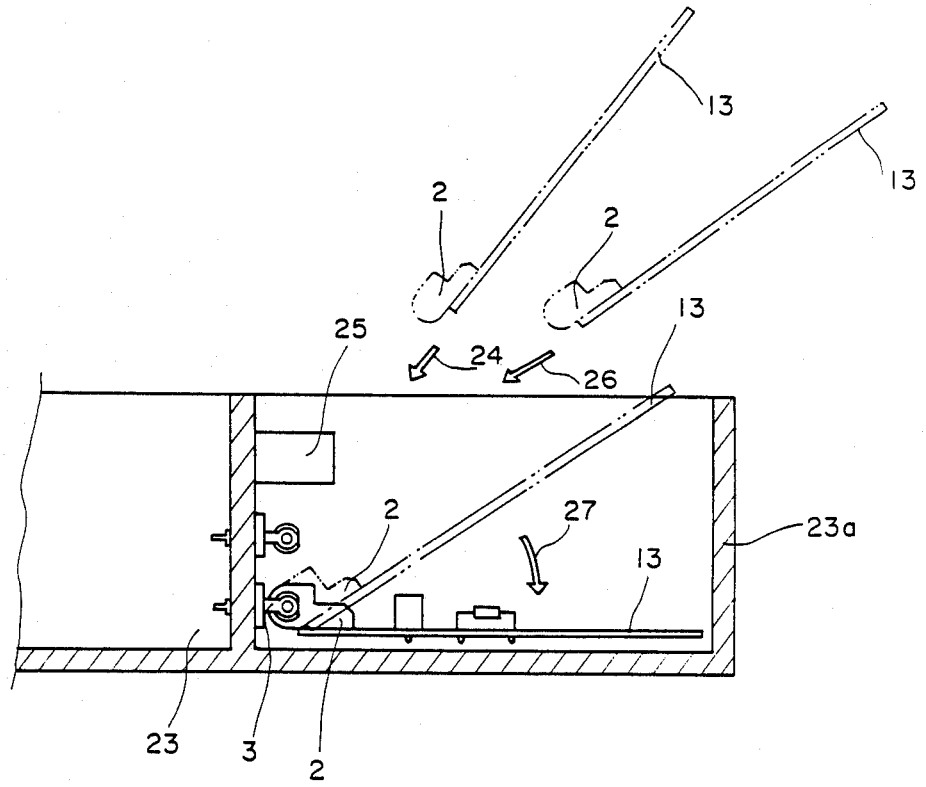
FIGS. 5 and 6 illustrate the mating engagement of the hingeable connector assembly of the present invention.
Figure 6:
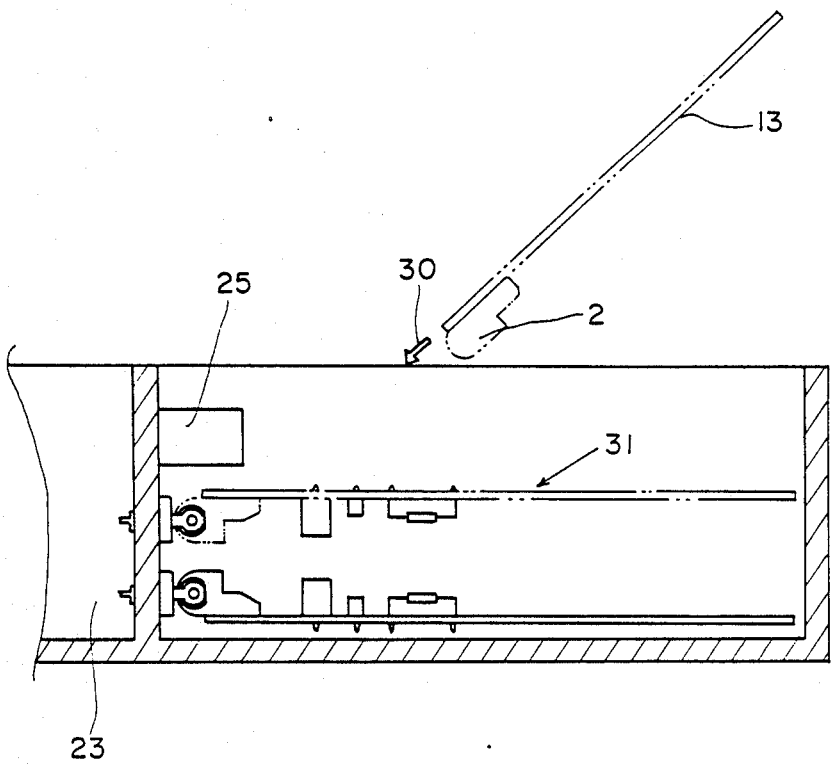

It is further possible to position the printed circuit board 13 in opposite fashion to that shown in FIG. 5, as best seen in FIG. 6, and to insert the connector into the casing 23, as indicated by an arrow 30. After insertion the printed circuit board 13 is rotated to the mounting position, as indicated by an arrow 31.

It is also possible to insert the female connector 2 in horizontal direction and then rotate the board 13 to the vertical position.

We claim:

1. A hingeable connector assembly including:

a female connector including a housing having a terminal receiving recess and at least one female terminal mounted in said terminal receiving recess;

a male connector including a housing with at least one male terminal mounted therein adapted to rotatably mate with said female terminal;

the improvement comprising:

said female terminal including a pair of spaced opposing coplanar terminal pieces with a holding space formed therebetween, said terminal pieces having contact portions on their opposing surfaces, respectively, one of said terminal pieces extending forwardly of the other and having an engaging projection on its opposing surface at the forward end thereof;

said male terminal including a forward end portion of substantially planar circular shape, having an engaging hole, said forward end portion adapted to be received in said holding space generally perpendicularly with respect to said terminal pieces so that the engaging projection of the female terminal is resiliently received within said engaging hole;

said terminal receiving recess having a bottom wall of arcuate shape corresponding to the forward end portion of substantially circular shape to support said forward end portion should external force be applied to the assembly;

whereby the male terminal and said female terminal may be rotated relative to each other about the point where said engaging projection is held in engagement with said engaging hole, while the contact portions of the female terminal member are constantly held in electrical contact with the male terminal member.

2. The hingeable connector assembly of claim 1, in which a plurality of female terminals are mounted in the female connector housing at a predetermined pitch in electrically insulated relation from each other and a plurality of male terminals are mounted in the male connector housing at the same pitch as the above-mentioned pitch.

* * * * *